US007192117B2

(12) United States Patent
Suzuki

(10) Patent No.: US 7,192,117 B2
(45) Date of Patent: Mar. 20, 2007

(54) PRINTER

(75) Inventor: Katsuhito Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 308 days.

(21) Appl. No.: 11/009,059

(22) Filed: Dec. 13, 2004

(65) Prior Publication Data

US 2005/0134638 A1 Jun. 23, 2005

(30) Foreign Application Priority Data

Dec. 22, 2003 (JP) ..... 2003-423954

(51) Int. Cl.
*B41J 23/00* (2006.01)
*B41J 29/38* (2006.01)

(52) U.S. Cl. ..... 347/37; 347/16

(58) Field of Classification Search ..... 347/19, 347/37, 16; 318/603, 604; 324/207.23, 324/207.24; 358/1.12, 1.15, 1.16
See application file for complete search history.

(56) References Cited

U.S. PATENT DOCUMENTS 6,367,906 B1 * 4/2002 Hiramatsu et al. ..... 347/34
2002/0101465 A1 * 8/2002 Maeda ..... 347/12

FOREIGN PATENT DOCUMENTS

JP A 07-281327 10/1995
JP A 08-101359 4/1996
JP A 09-015766 1/1997
JP A 11-188866 7/1999
JP A 2000-103135 4/2000
JP A 2001-255606 9/2001

* cited by examiner

*Primary Examiner*—Stephen Meier
*Assistant Examiner*—Lisa M. Solomon
(74) *Attorney, Agent, or Firm*—Oliff & Berridge, PLC

(57) ABSTRACT

To provide a printer capable of matching arrangement cycles of parallax images and lenses with each other inexpensively and easily. There is provided a printer comprising: a recording head that discharges ink to a predetermined position of a recording medium while being moved in a main scan direction relative to the recording medium on which an image is printed; a recording-head moving unit that moves the recording head in the main scan direction; a recording-medium moving unit that moves the recording medium in a auxiliary scan direction relative to the recording head; and an encoder that measures at least one of the movement of the recording head and the movement of the recording medium, wherein the encoder includes a scale having calibrations of which an interval is varied in one of a direction different from the movement direction of the recording head and the movement direction of the recording medium and a measuring portion that detects the calibrations, and wherein the interval of the calibrations to be detected by the measuring portion is varied by relatively moving the scale and the measuring portion in one of a direction different from the movement direction of the recording head and the movement direction of the recording medium.

10 Claims, 6 Drawing Sheets

PRINTER

BACKGROUND

The present invention relates to a printer.

Conventionally, as a three-dimensional image, there have been widely known a three-dimensional image which was obtained by synchronizing a plurality of images taken from plural directions in a stripe shape and which was three-dimensionally visible by observing separately with left and right eyes parallax images, which were recorded on the rear surface of a lenticular sheet having a plurality of pillar-shaped aspherical lenses arranged on the front surface, transmitting through the pillar-shaped aspherical lenses of the lenticular sheet from the front surface side of the lenticular sheet.

In addition to the aforementioned three-dimensional image, there have been also known three-dimensional images which were obtained using a technology called an integral photography employing a plurality of two-dimensionally arranged convex lenses, for example, faveolate lenses.

The three-dimensional images are obtained by recording parallax images at positions corresponding to a plurality of lenses such as pillar-shaped spherical lenses or faveolate lenses, and have an advantage that it is not necessary to utilize special spectacles such as spectacles in which separate colors are disposed to both eye portions, and the like.

As methods of forming the three-dimensional images, there has been suggested, for example, a technology of recording parallax images on the rear surface of a lenticular sheet at the same cycle as an arrangement cycle of the lenses of the lenticular sheet using a printer such as an inkjet printer, etc. (for example, see Patent Documents 1 to 5).

[Patent Document 1] Japanese Unexamined Patent Application Publication No. 8-101359

[Patent Document 2] Japanese Unexamined Patent Application Publication No. 7-281327

[Patent Document 3] Japanese Unexamined Patent Application Publication No. 9-15766

[Patent Document 4] Japanese Unexamined Patent Application Publication No. 11-188866

[Patent Document 5] Japanese Unexamined Patent Application Publication No. 2001-255606

[Patent Document 6] Japanese Unexamined Patent Application Publication No. 2000-103135

In Patent Document 1 described above, a technology of absorbing difference in cycle between lenses and parallax images of a lenticular sheet by adjusting the parallax images to be printed is disclosed. However, in the above technology, it is difficult to completely absorb the difference in cycle between the lenses and the parallax images of the lenticular sheet. That is, since the minimum value for adjustment of the parallax images is determined depending upon the maximum resolution of the printer printing the parallax images, finer adjustment cannot be performed. That is, since minute difference in cycle between the lenses and the parallax images of the lenticular sheet remains, it is difficult to realize a three-dimensional image with high quality.

In Patent Document 2 and Patent Document 3 described above, a technology of utilizing a lenticular sheet having lenses with a cycle matching a driving cycle of a printer printing parallax images is disclosed. However, in the above technology, since it is necessary to utilize the lenticular sheet having the same cycle as the driving cycle of the printer, there is a problem that the range for selection of the lenticular sheet is restricted and manufacturing cost and running cost are increased due to a special order for lenticular sheets which are an expendable item.

In Patent Document 4 and Patent Document 5, a technology that a printer printing parallax images forms lenses on a target to be printed is disclosed. However, in the above technology, since many positions of which specifications should be changed and many elements which should be newly developed exist in a currently used printer, there is a problem that much time is required for realization thereof.

In addition to the aforementioned technologies, there has been a technology of matching a driving cycle of a printer with a cycle of lenses of a lenticular sheet. The driving cycle of a printer is determined using parameters such as a driving frequency, a printing speed, a resolution of a linear encoder, etc. The driving frequency and the printing speed can be changed to desired values by changing parameters of the software controlling them. However, since it is difficult to change the resolution of a linear encoder and only one kind of resolution can be expressed as disclosed in Patent Document 6, it is difficult to completely match the cycle of the parallax images with the cycle of the lenses of a lenticular sheet.

SUMMARY

The present invention is contrived to solve the above problems and it is an object to provide a printer capable of matching arrangement cycles of parallax images and lenses with each other inexpensively and easily.

In order to accomplish the above object, according to the present invention, there is provided a printer comprising: a recording head that discharges ink to a predetermined position of a recording medium while being moved in a main scan direction relative to the recording medium on which an image is printed; a recording-head moving unit that moves the recording head in the main scan direction; a recording-medium moving unit that moves the recording medium in a auxiliary scan direction relative to the recording head; and an encoder that measures at least one of the movement of the recording head and the movement of the recording medium, wherein the encoder includes a scale having calibrations of which an interval is varied in one of a direction different from the movement direction of the recording head and the movement direction of the recording medium and a measuring portion that detects the calibrations, and wherein the interval of the calibrations to be detected by the measuring portion is varied by relatively moving the scale and the measuring portion in one of a direction different from the movement direction of the recording head and the movement direction of the recording medium.

That is, the encoder of the printer according to the present invention can vary the interval of the calibrations to be detected by the measuring portion, by relatively moving the scale and the measuring portion in one of the direction different from the movement direction of the recording head and the movement direction of the recording medium. As a result, the encoder can have different resolutions, and thus can measure the movement of the recording head with a desired resolution.

Accordingly, in the printer according to the present invention, the recording head or the recording medium can be moved with a predetermined cycle, so that it is possible to print images with the predetermined cycle. Therefore, for example, when a lenticular sheet is used as the recording medium, it is possible to easily match the cycle of parallax images with the arrangement cycle of lenses of the lenticular sheet. Since various arrangement cycles of lenses can be coped with, the range for selection of a lenticular sheet can be widened and the lenticular sheets which are a mass-produced item can be used, thereby reducing running cost.

In order to embody the above construction, more specifically, the scale may be formed in a rectangular shape and the calibrations may be formed to intersect the lengthwise axis direction of the scale. Further, the scale may be arranged such that the lengthwise axis direction is parallel or substantially parallel to the movement direction of the recording head or the movement direction of the recording-medium.

According to this construction, since the lengthwise axis direction of the scale is parallel or substantially parallel to the movement direction of the recording head or the movement direction of the recording-medium, the lengthwise axis direction of the scale is substantially equal to the movement direction of the recording head or the movement direction of the recording medium. Further, since the calibrations are formed to intersect the lengthwise axis direction, it is possible to easily measure the moving distance of the recording head or the moving distance of the recording medium.

In order to embody the above construction, more specifically, the interval of the calibrations may be varied in a direction intersecting the main scan direction (including a direction perpendicular to the main scan direction and a direction approximately perpendicular thereto).

According to this construction, since the calibration interval is varied in a direction intersecting the main scan direction (including a direction perpendicular to the main scan direction and a direction approximately perpendicular thereto), it is possible to vary the calibration interval used for measurement by moving the relative position between the scale and the measuring portion in the direction intersecting the main scan direction (including a direction perpendicular to the main scan direction and a direction approximately perpendicular thereto).

In order to embody the above construction, more specifically, the calibrations may be formed out of a plurality of straight lines extending radially from a predetermined point outside the scale.

According to this construction, since the calibrations are formed out of a plurality of straight lines extending radially from a predetermined point outside the scale, the calibration interval is continuously varied in the direction intersecting the main scan direction (including a direction perpendicular to the main scan direction and a direction approximately perpendicular thereto).

In order to embody the above construction, more specifically, the measuring portion may be attached to the recording head, the scale may be attached to a belt that is wound around a pair of rollers rotatably disposed and extends in a direction approximately perpendicular to the movement direction of the recording head, and one roller may be provided with a motor that drives the scale in the direction intersecting the movement direction of the recording head (including a direction perpendicular to the movement direction of the recording head and a direction approximately perpendicular thereto) via the roller and the belt.

According to this construction, since the scale is attached to the belt that is driven in the direction intersecting the movement direction of the recording head (including a direction perpendicular to the movement direction of the recording head and a direction approximately perpendicular thereto) by the motor, the positional relation of the scale relative to the measuring portion can be changed by driving the scale in the intersecting direction (including a perpendicular direction perpendicular or a approximately-perpendicular direction), thereby varying the calibration interval used for measurement.

By attaching the measuring portion to the recording head and driving the scale in the direction intersecting the movement direction of the recording head (including a direction perpendicular to the movement direction of the recording head and a direction approximately perpendicular thereto), the recording head may be formed to be movable only in the main scan direction. Accordingly, the construction can be simplified and it is thus not necessary to drastically change the conventional construction.

In order to embody the above construction, more specifically, the scale may be moved in the lengthwise axis direction by the recording-medium moving unit in synchronism with the movement of the recording medium, the measuring portion may be attached to a belt that is wound around a pair of rollers rotatably disposed and extends in a direction intersecting the lengthwise axis direction (including a direction perpendicular to the lengthwise axis direction and a direction approximately perpendicular thereto), and one roller may be provided with a motor that drives the measuring portion in the direction intersecting the lengthwise axis direction (including a direction perpendicular to the lengthwise axis direction and a direction approximately perpendicular thereto) via the roller and the belt.

According to this construction, since the measuring portion is attached to the belt that is driven in the direction intersecting the lengthwise axis direction of the scale (including a direction perpendicular to the lengthwise axis direction and a direction approximately perpendicular thereto) by the motor, the positional relation of the measuring portion relative to the scale by driving the measuring portion in the intersecting direction (including the perpendicular direction and the approximately-perpendicular direction) can be changed, thereby varying the calibration interval used for measurement.

In order to embody the above construction, more specifically, variation of the calibration interval of the scale may be performed by selecting a calibration interval after variation from a plurality of the calibration intervals of the scale, changing relative positions of the scale and the measuring portion such that the calibration interval measured by the encoder becomes the calibration interval after variation, and changing a driving cycle of the recording head and an imaging speed of an image on the basis of the calibration interval after variation.

According to this construction, the interval of the calibrations to be measured by the encoder, the driving cycle of the recording head, and the imaging speed or the printing speed of an image are changed on the basis of the selected calibration interval after variation. As a result, it is possible to print an image at a predetermined cycle, for example, by selecting the calibration interval in accordance with a cycle required for the image to be printed on the recording medium.

In order to embody the above construction, more specifically, the recording medium may be one of a lens sheet having a plurality of lenses arranged on one surface thereof and a print medium having convexities and concavities corresponding to lenses, and the calibration interval after variation may be selected on the basis of the number of parallax images and one of an arrangement cycle of the lenses and the convexities and concavities corresponding to the lenses.

According to this construction, since the calibration interval after variation is selected on the basis of a predetermined number of parallaxes and one of the arrangement cycle of the lenses of the recording medium and the convexities and concavities corresponding to the lenses, it is possible to print parallax images different by the number of parallax images, for example, in an area of the recording medium where the lenses or the convexities and concavities corresponding to the lenses are arranged, at the cycle equal to the arrangement cycle of the lenses or the convexities and concavities corresponding to the lenses. The number of dots required for forming the respective parallax images can be applied to all the parallax images.

In order to embody the above construction, more specifically, the variation of the calibration interval to be measured by the encoder may be performed by moving the scale in the main scan direction through control of driving the motor and thus changing the relative position between the scale and the measuring portion.

According to this construction, since the variation of the calibration interval to be measured by the encoder is performed by moving the scale in the main scan direction through control of driving the motor, the relative position between the scale and the measuring portion can be controlled, so that it is possible to change the calibration interval to be measured by the encoder to a predetermined calibration interval.

DETAILED DESCRIPTION OF EMBODIMENTS

Hereinafter, preferred embodiments of the present invention will be described in detail with reference to the drawings.

The embodiments to be described below is intended to explain a gist of the present invention, but is not intended to limit the present invention as far as specific restrictions do not exist.

In the present embodiment, an example where a three-dimensional image sheet is produced using a printer for forming lenses on the same surface as the surface of a recording medium on which parallax images are recorded will be described.

Figure 1:
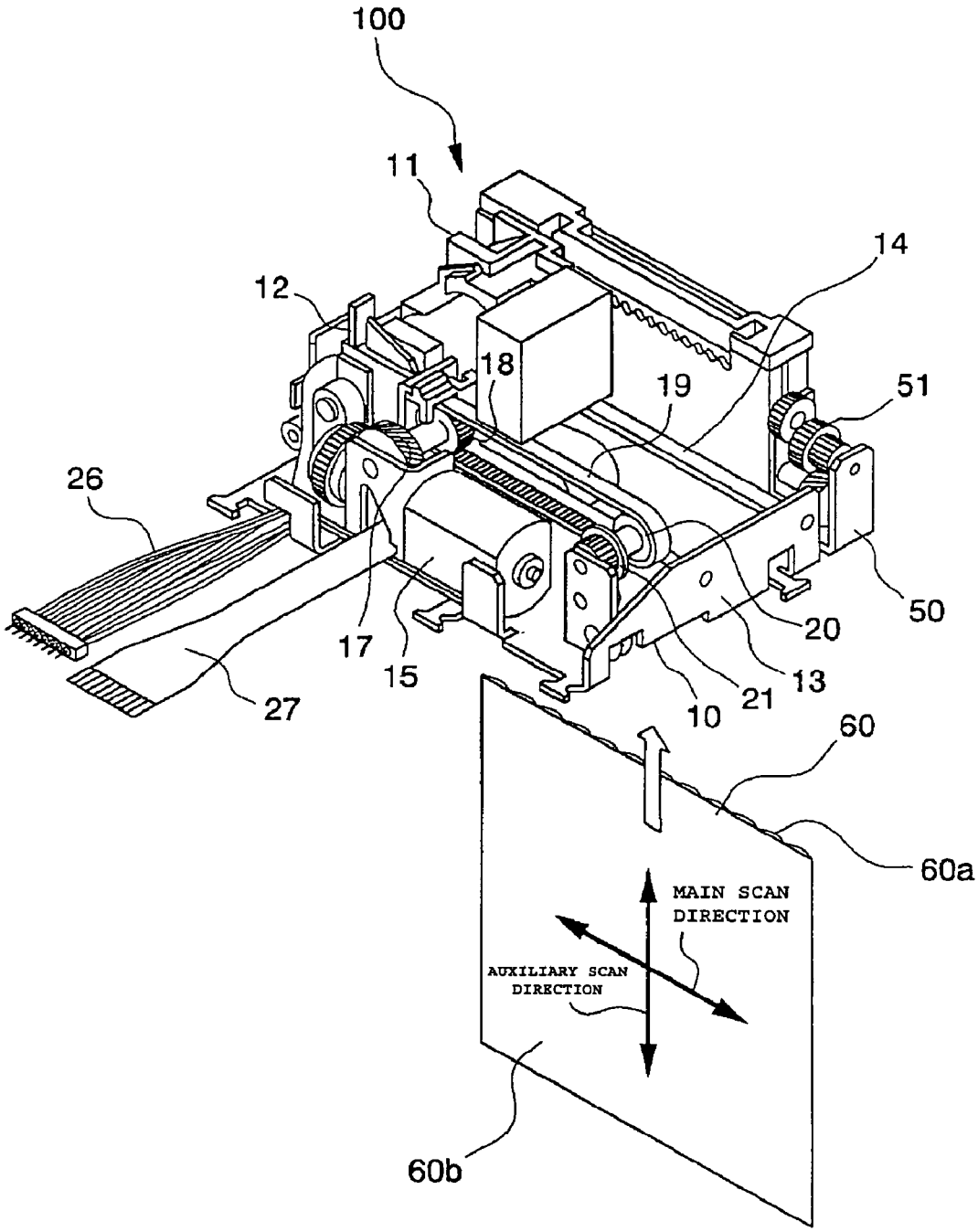
FIG. 1 is a perspective view illustrating an embodiment of a printer according to the present invention.
Figure 2:
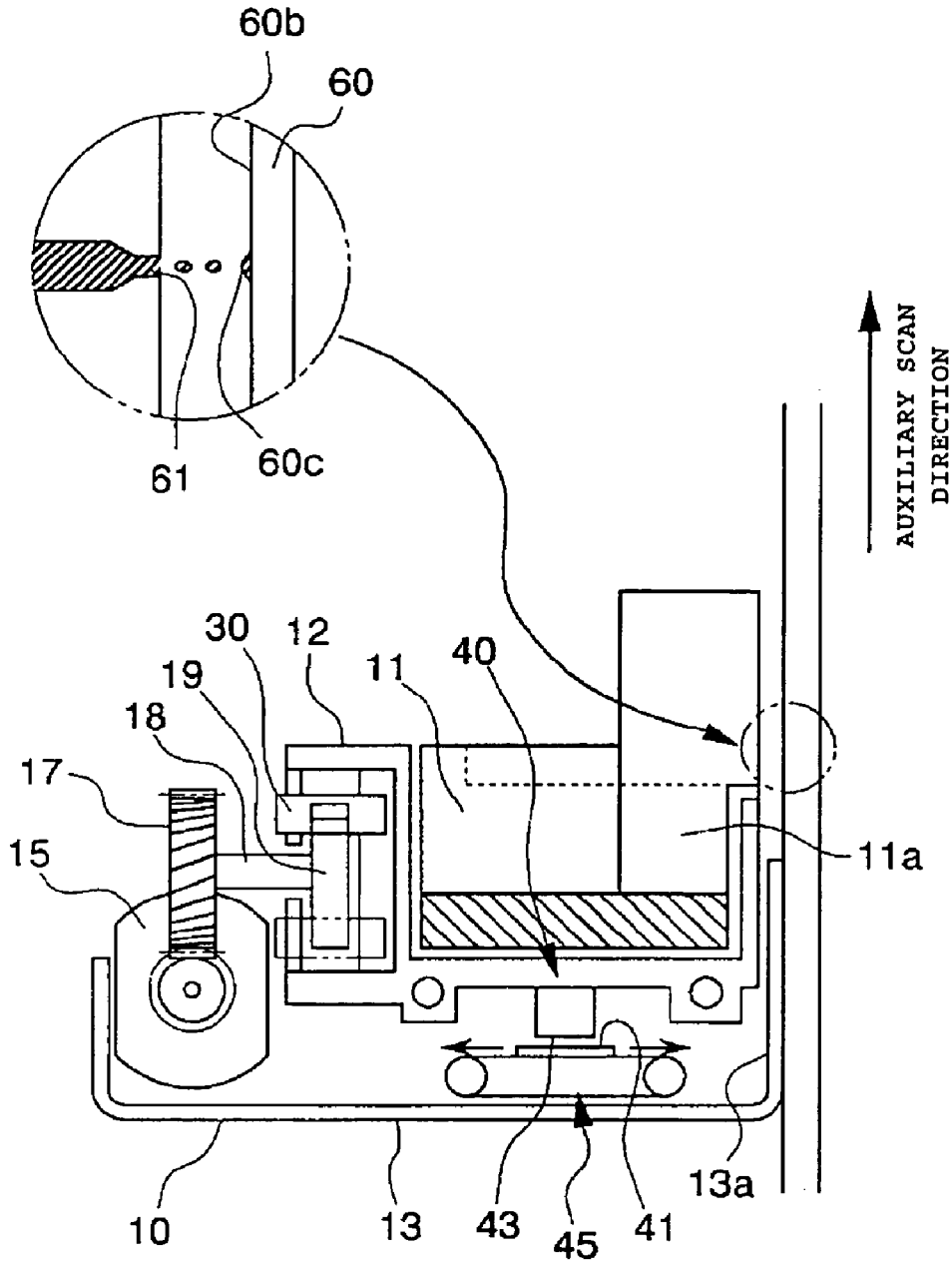
FIG. 2 is a partially-enlarged cross-sectional view illustrating a periphery of a recording head in the printer according to the present invention.

FIG. 1 is a perspective view illustrating an example of the printer according to the present invention and FIG. 2 is a partially-enlarged view illustrating a periphery of a recording head in the printer shown in FIG. 1, illustrating a state where a recording medium is inserted into the printer.

In FIG. 1, a reference numeral 100 denotes a printer. The printer 100 approximately comprises a main body 10 and a sheet feed unit (recording-medium moving unit or recording-medium moving means) 50.

In FIG. 1, a reference numeral 60 denotes a lenticular sheet (recording medium). In the lenticular sheet 60, lenticular lenses (lenses) 60*a* which are a pillar-shaped aspherical lens are disposed approximately at regular intervals on one surface thereof, and a printing surface 60*b* having an ink-absorbing layer for absorbing ink for printing is formed on the other surface.

As shown in FIGS. 1 and 2, the main body 10 is provided with a carriage 12 as a support member for supporting a cartridge 11 and a carriage moving means (recording-head moving unit or recording-head moving means) to be described later. A recording head 11*a* and the cartridge 11 mounted with an ink envelope (not shown) are fitted to the carriage 12.

As shown in FIG. 2, the recording head 11*a* records a parallax image 60*c* on the printing surface 60*b* of the lenticular sheet 60 by discharging the ink of the ink envelope from a nozzle 61 and performs the recording using a liquid crystal discharging method, that is, a so-called inkjet method.

The recording head 11*a* is practically used, for example, for an inkjet printer, and a piezo-jet type recording head employing a piezoelectric element, a Bubble Jet (registered trademark) type recording head, etc. employing an electrothermal conversion member as an energy-generating element. Here, a coloring area and a coloring pattern can be arbitrarily set.

As shown in FIGS. 1 and 2, a carriage moving means moves the carriage 12 in the main scan direction, and comprises a frame 13, a guide bar 14, a motor 15, gears 17, 21, a driving wheel 18, a timing belt 19, and a driven wheel 20.

As shown in FIG. 1, the carriage 12 is supported to be movable in the width direction (main scan direction) of the guide bar 14 by a pair of guide bars 14 provided in the frame 13. For example, a DC motor is provided as the motor 15 which is a driving source for driving the carriage 12 and is rotationally driven in a constant direction.

As shown in FIG. 2, a first linear encoder (encoder) 40 for measuring the moving distance of the recording head 11*a* and a first resolution variation section 45 are provided between the downside of the carriage 12 and the frame 13. The moving distance of the recording head 11*a* measured by the first linear encoder 40 is used for positional control correction of the recording head 11*a*. A positional control error of the recording head 11*a* is reduced using the first linear encoder 40, so that it is possible to print parallax images at more accurate positions.

The first linear encoder 40 and the first resolution variation section 45 may be disposed between the downside of the carriage 12 and the frame 13 as shown in FIG. 2, and may be disposed between one lateral side of the carriage 12 and the frame 13. The disposal positions thereof are not specifically restricted.

FIG. 3A is a schematic diagram illustrating the first linear encoder and FIG. 3B is a diagram illustrating a scale of the first linear encoder.

As shown in FIGS. 3A and 3B, the first linear encoder 40 approximately comprises a scale 41 on which calibrations 42 are formed and a sensor (measuring portion) 43 such as a CCD (Charge Coupled Device) camera for optically detecting the calibrations 42 formed on the scale 41. The first resolution variation section 45 approximately comprises a belt 47 wound around a pair of rollers 46 and a motor 48 for rotationally driving one of the pair of rollers 46.

As shown in FIGS. 3A and 3B, the scale 41 is made of a measured member 44 having approximately a rectangular shape and calibrations 42 are formed on the measured member 44. The calibrations 42 are formed, as shown in FIG. 4, out of straight lines L which are expanded radially and at regular intervals toward the measured member 44 from a virtual point (a predetermined point) which is deviated in a minor-axis direction from one end portion of the measured member 44. The calibration interval 42 of the scale 41 is, for example, about 8.8 μm (corresponding to 1/2880 dpi (dot per inch)) at the side where the interval is narrow (the interval at the upper end of FIG. 3B), and about 9.4 μm (corresponding to 1/2700 dpi) at the side where the interval is broad (the interval at the lower end of FIG. 3B). The interval of the calibrations 42 therebetween is linearly varied (widened) from the narrow side to the broad side.

FIG. 4 is a diagram illustrating a method of forming the calibrations of the scale.

The calibrations 42 may have the aforementioned interval, may have an interval broader than the aforementioned interval, and may have an interval narrower than the aforementioned interval. The virtual point P may be placed at the position which is deviated in the minor-axis direction from the end portion of the measured member 44 as shown in FIG. 4 and may be placed at a position which is deviated in the minor-axis direction from the approximately central portion of the measured member 44. The first linear encoder 40 may detect the calibrations 42 of the scale 41 with a sensor such as a CCD camera, etc. and may detect the calibrations with a magnetic sensor using the calibrations 42 of the scale 41 as magnetic calibrations. The measured member 44 of the scale 41 may be made of an opaque material which does not transmit light and may be made of a transparent material such as glass, polycarbonate, vinyl chloride, etc. In addition, the measured member 44 may be made of a rigid material (having high rigidity) and may be made of a soft material (having low rigidity).

As shown in FIG. 3A, the first resolution variation section 45 comprises a pair of belts 47 wound around rollers 46 in parallel to each other, and the belts 47 are disposed to extend in a direction approximately perpendicular to the main scan direction. The rollers 46 of the belts 47 are provided with a motor 48, respectively, and the belts 47 are driven with the motors 48 via the rollers. The motor 48 may be provided in the roller 46 of the respective belts 47 as described above, and the rollers 46 of the respective belts 47 may be supported by a common rotational shaft and driven with only one motor 48.

As shown in FIG. 1, control lines 26 for driving the motor 15, etc. or taking out signals and control lines 27 for inputting control signals for driving the recording head are connected to the main body 10.

As shown in FIGS. 2 and 3A, the scale 41 is disposed on the belt 47 of the first resolution variation section 45 such that the lengthwise axis direction is parallel or approximately parallel to the main scan direction, and is movable in a direction intersecting the main scan direction (including a direction perpendicular to the main scan direction and a direction approximately perpendicular thereto) together with the belt 47. the sensor 43 is disposed on the lower surface of the carriage 12 and is movable in the main scan direction together with the carriage 12.

As shown in FIG. 1, the sheet feed unit 50 is screw-coupled to a guide surface 13*a* which is formed by bending the frame 13 of the main body 10 upwardly at the right angle, and thus is fixed to the main body 10. For the purpose of driving the sheet feed unit 50, the rotation of a gear 21 connected to the driven wheel 20 is supplied via a gear group 51 and a transfer shift (not shown). The gear group 51 is connected to a pair of sheet supply roller and sends out the lenticular sheet 60 inserted into the printer 100 by a predetermined amount.

Figure 5:
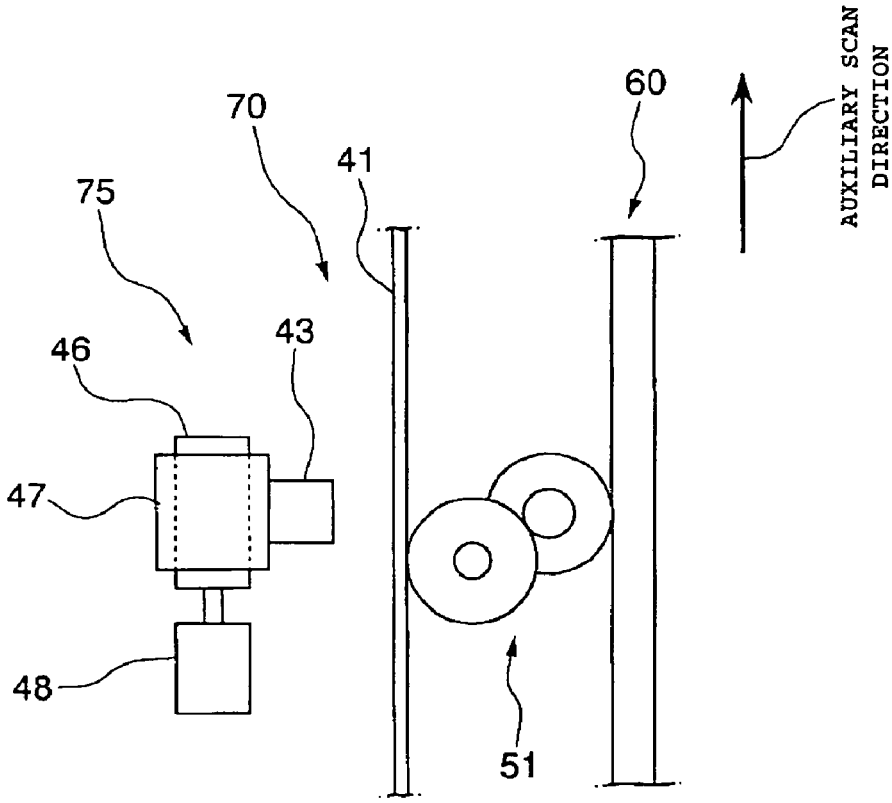
FIG. 5 is a partially-enlarged view illustrating the linear encoder in the printer according to the present invention.
Figure 5:
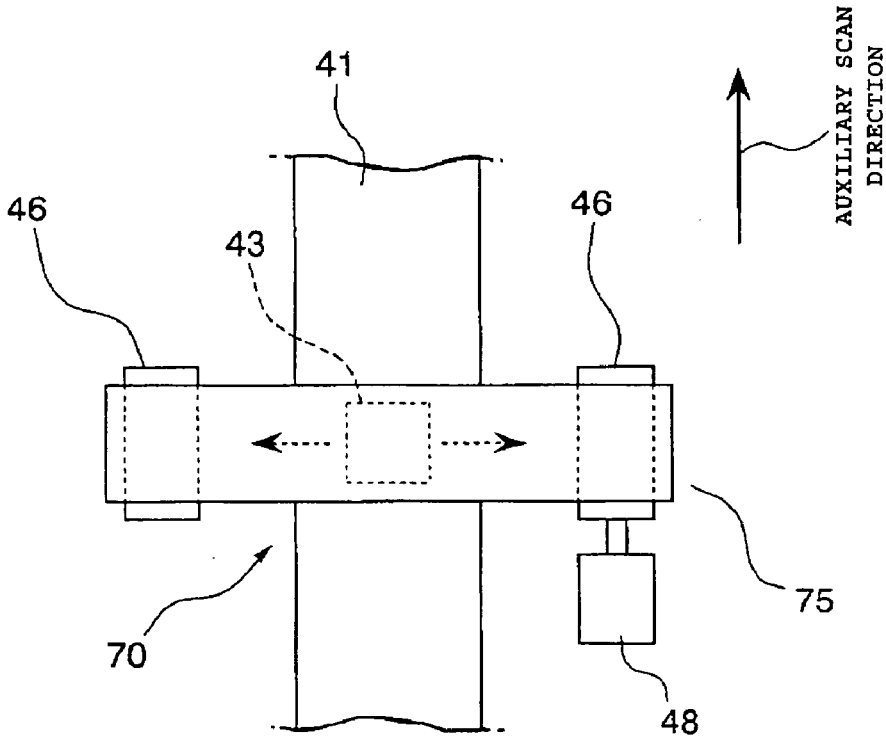

FIG. 5A is a partial cross-sectional view illustrating a structure of the linear encoder in the auxiliary scan direction, and FIG. 5B is a partial plan view illustrating a structure of the linear encoder.

The sheet feed unit 50 is provided with a second linear encoder 70 for measuring the moving distance of the lenticular sheet 60 and a second resolution variation section 75. The moving distance of the lenticular sheet 60 measured by the second linear encoder 70 is used for positional control correction of the lenticular sheet 60. A positional control error of the lenticular sheet 60 is reduced using the second linear encoder 70, so that it is possible to print parallax images at more accurate positions.

The second linear encoder 70 approximately comprises a scale 41 on which calibrations are formed and a sensor 43 such as a CCD camera for optically detecting the calibrations, similarly to the first linear encoder 40. The second resolution variation section 75 approximately comprises a belt 47 wound around a pair of rollers 46 and a motor 48 for rotationally driving one of the pair of rollers 46, similarly to the first resolution variation section 45.

As shown in FIGS. 5A and 5B, the second resolution variation section 75 comprises a belt 47 wound around rollers 46, and the belt 47 is disposed to extend in a direction intersecting the auxiliary scan direction (including a direction to perpendicular to the auxiliary scan direction and a direction approximately perpendicular thereto). The roller 46 of the belt 47 is provided with a motor 48, and the belt 47 is driven with the motor 48 via the rollers.

A sensor 43 is disposed on the belt 47 of the second resolution variation section 75 and is movable in the direction intersecting the auxiliary scan direction (including a direction perpendicular to the auxiliary scan direction and a direction approximately perpendicular thereto) together with the belt 47.

The scale 41 is disposed such that the lengthwise axis direction thereof is matching the auxiliary scan direction and such that the opposite surface of the surface on which the calibrations 42 are formed is in contact with gears of the gear group 51. The opposite surface is formed to engage with the gears of the gear group 51.

For example, when the diameter of the gear driving the scale 41 is equal to the diameter of the sheet supply roller, the moved amount of the scale 41 and the moved amount of the lenticular sheet 60 are equal to each other. Since the ratio between the moved amount of the scale 41 and the moved amount of the lenticular sheet 60 is constant even when the diameter of the gear and the diameter of the sheet supply roller are different from each other, it is possible to measure the moved amount of the lenticular sheet 60. Although not shown in the figures, the scale 41 may be provided with a structure for winding up the scale and may be provided with a structure for circulating the scale, at the upper side or the lower side in FIG. 5A.

Next, a method of manufacturing the three-dimensional image sheet 6 shown in FIG. 4 using the printer 100 by recording the parallax images 60*c* on the lenticular sheet 60 and forming the lenticular lenses 60*a* at the positions corresponding to the respective parallax images 60*c* in the lenticular sheet 60 will be described.

First, as shown in FIGS. 1 and 2, when the control voltage is supplied to the motor 15, etc. through the control lines 26 and the control signals are supplied to the recording head 11*a* through the control lines 27, the lenticular sheet 60 is inserted into the printer 100 and is moved in the auxiliary scan direction relative to the recording head 11*a* by the sheet feed unit 50. Specifically, the gear 21 connected to the driven wheel 20 is rotated through the gear 17, the driving wheel 18, and the timing belt 19 by the motor 15. When the gear 21 is rotationally driven, the gear group 51 is rotationally driven via the transfer shaft (not shown) and a pair of sheet supply rollers is rotationally driven. The lenticular sheet 60 is moved by means of the rotation of the sheet supply roller.

The lenticular sheet 60 is placed at the position where the parallax images are recorded in the auxiliary scan direction relative to the recording head 11*a*.

Next, the recording head 11*a* is moved in the main scan direction with the carriage moving means. Specifically, the gear 17 and the driving wheel 18 are rotationally driven by the motor 15 and the timing belt 19 is rotationally driven by the driving wheel 18. When the timing belt 19 is rotationally driven, the driven wheel 20 is rotated and thus the gear 21 connected to the driven wheel 20 is rotated. Since the timing belt 19 is provided with a driving pin 30 for allowing the carriage 12 to reciprocate, the carriage 12 reciprocates by means of the rotation of the timing belt 19 in a single direction. The reciprocation of the carriage 12 is basically controlled by means of the rotation of the motor 15 and the moving distance of the carriage 12 measured by the first linear encoder 40 is mainly used for correction.

Figure 3:
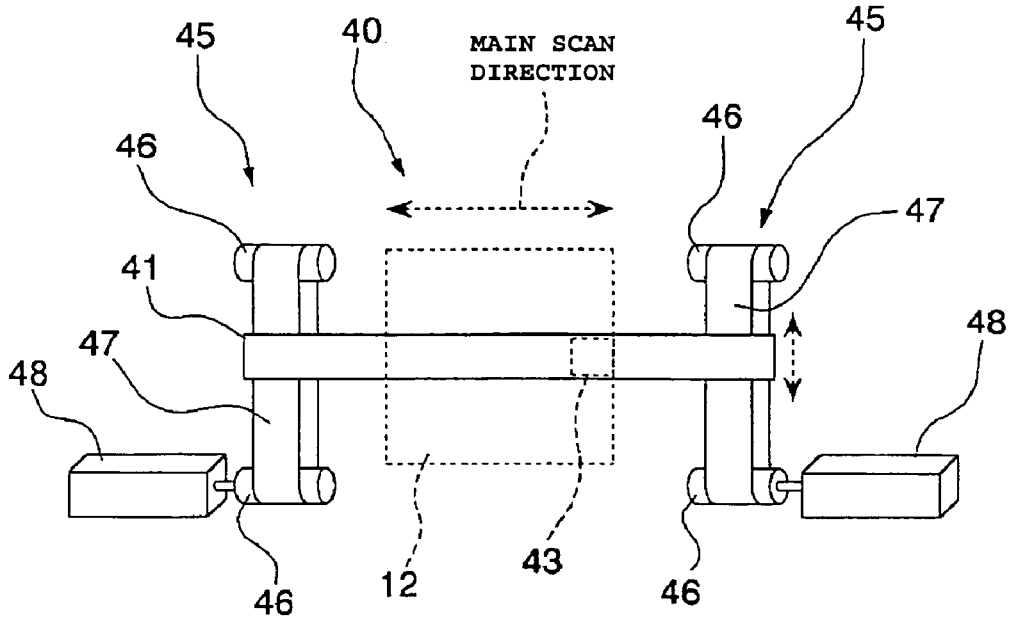
FIG. 3 is a partially-enlarged view illustrating a linear encoder in the printer according to the present invention.
Figure 3:
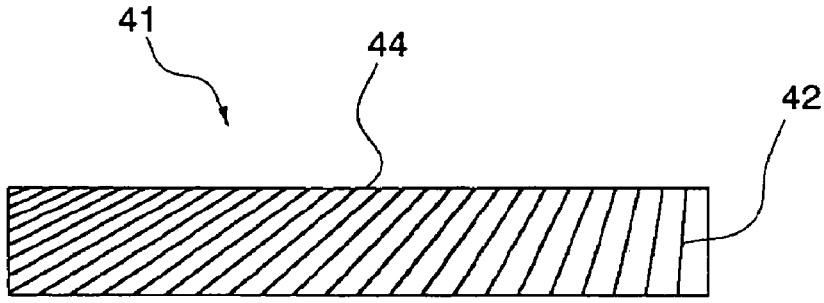
Figure 4:
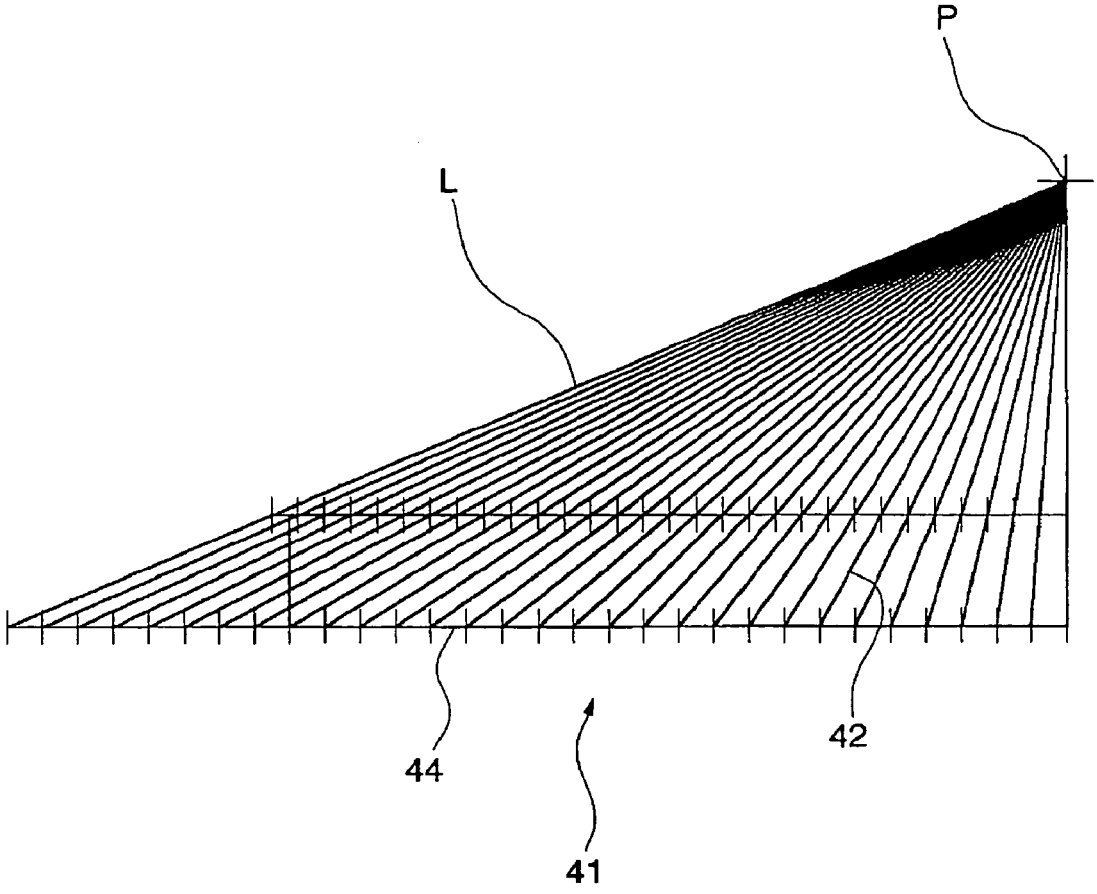
FIG. 4 is a diagram illustrating calibrations of a scale of the linear encoder in the printer according to the present invention.

As described above, when it is moved in the main scan direction relatively to the lenticular sheet 60, the recording head 11*a* records the parallax images 60*c*, as shown in FIG. 3, by discharging ink of the ink envelope toward the lenticular sheet 60 from the nozzle 61 in synchronism with the movement of the recording head 11*a*.

Next, a method of allowing the printer 100 to print the parallax images 60*c* in accordance with the arrangement cycle of the lenticular lenses 60*a* of the lenticular sheet 60.

Since the method of printing the parallax images 60*c* in accordance with the arrangement cycle of the lenticular lenses 60*a* using the first linear encoder 40 and the method of printing the parallax images 60*c* in accordance with the arrangement cycle using the second linear encoder 70 have approximately equivalent operation and effects, the method of printing the parallax images 60*c* in accordance with the arrangement cycle using the first linear encoder 40 will be mainly described herein.

Figure 6:
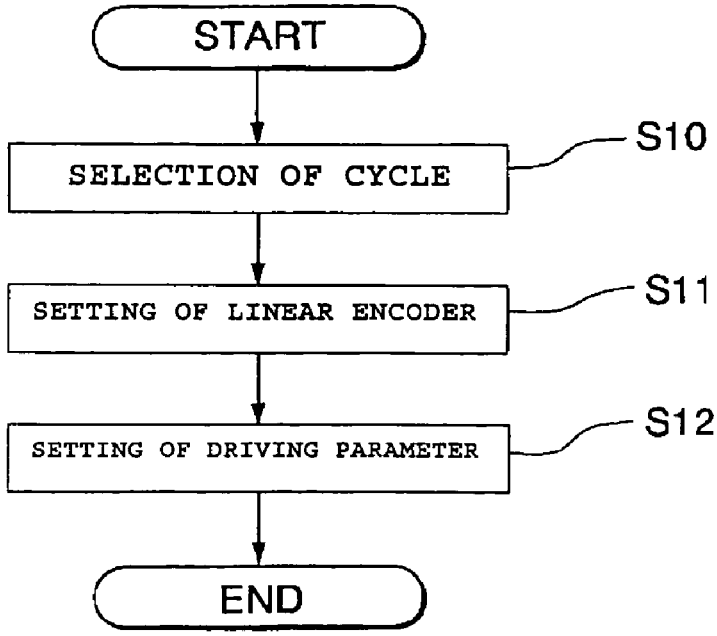
FIG. 6 is a flowchart illustrating variation of a calibration interval in the printer according to the present invention.

FIG. 6 is a flowchart illustrating a method of printing the parallax images 60*c* in accordance with the arrangement cycle of the lenticular lenses 60*a*.

As shown in FIG. 6, the method of printing the parallax images 60*c* in accordance with the arrangement cycle of the lenticular lenses 60*a* approximately comprises a cycle selecting process S10, a linear encoder setting process S11, and a driving parameter setting process S12.

At the cycle selecting process S10, first, one interval of the calibrations 42 is selected from an interval range of the calibrations 42 of the scale 41 in the first linear encoder 40 on the basis of the arrangement cycle of the lenticular lenses 60*a* of the lenticular sheet 60. In the method of selecting an interval of the calibrations 42, an interval of the calibrations 42 which is divided by the arrangement cycle of the lenticular lenses 60*a* is first selected sequentially from the side where the interval of the calibrations 42 is narrow (from the side where the resolution is high). When the divided interval of the calibrations 42 exists plurally, the interval of the calibrations 42 which is divided by the number of parallax images is first selected sequentially from a small interval of the calibrations 42. The number of parallax images means the number of images used for printing a three-dimensional image or printing a motion. For example, supposed that the arrangement cycle of the lenticular lenses 60*a* is 73 dpi (about 347.9 μm), 1/2847 dpi (about 8.9 μm) is selected as the interval of the calibrations 42.

As the arrangement cycle of the lenticular lenses 60*a* used for the cycle selecting process S10, a value obtained by allowing a sensor (not shown) provided in the printer 100 to automatically detect the arrangement cycle of the lenticular lenses 60*a* when the lenticular sheet 60 is supplied to the printer 100 may be used and a value obtained by allowing a user to input a predetermined arrangement cycle of the lenticular lenses 60*a* to the printer 100 maybe used.

At the linear encoder setting process S11, the relative positional relation between the scale 41 and the sensor 43 is adjusted such that the first linear encoder 40 can perform measurement with the interval of the calibrations 42 selected at the cycle selecting process S10. The relative positional relation between the scale 41 and the sensor 43 is varied and adjusted by allowing the motor 48 to move the scale 41 in the direction intersecting the main scan direction (including a direction perpendicular to the main scan direction and a direction approximately perpendicular thereto) via the belt 47.

At the driving parameter setting process S12, the setting of two driving parameters (a driving frequency and a printing speed) of the carriage 12 is changed on the basis of the interval of the calibrations 42 selected at the cycle selecting process S10. For example, when the interval of the calibrations 42 is 1/2847 dpi (about 8.9 μm), the target resolution of an image to be printed is 2847 dpi (which is a resolution where the interval of dots is about 8.9 μm), and the target driving frequency is 14400 Hz, the printing speed of about 5.05 inch/s (about 128.27 mm/s) is obtained from the relational expression of (printing speed)=(driving frequency)/(resolution). Therefore, by controlling the carriage 12 on the basis of the above values, it is possible to print the parallax images 60*c* in accordance with the arrangement cycle of the lenticular lenses 60*a* and also to change the resolution of the parallax images 60*c*.

As described above, the printing speed may be calculated on the basis of the resolution and the driving frequency, and the driving frequency may be calculated on the basis of the resolution and the printing speed. For example, when the target resolution is 2847 dpi and the target printing speed is 20 inch/s (508 mm/s), the driving frequency is 56940 Hz.

According to the above construction, it is possible to vary the interval of the calibrations to be detected by the sensor 43 by relatively moving the scale 41 and the sensor 43 in a direction different from the main scan direction. Accordingly, since the first linear encoder 40 can have different resolutions, it is possible to measure the movement of the recording head 11*a* with a desired resolution. As a result, the printer 100 according to the present invention can precisely move the recording head 11*a* by a desired distance and thus can print an image with a desired resolution. It is also possible to easily allow the arrangement cycle of the lenticular lenses 60*a* of the lenticular sheet 60 and the resolution and the cycle of the parallax images to correspond to each other.

Since various arrangement cycles of various lenses 60*a* can be coped with, the range for selection of the lenticular sheet 60 is widened and it is thus possible to reduce the running cost of the printer 100 by utilizing the lenticular sheet 60 which is a mass-produced item.

Since the calibrations 42 are formed out of a plurality of straight lines extending radially from a virtual point P located outside the scale 41, the interval of the calibrations 42 is continuously varied in the direction intersecting the main scan direction (including a direction perpendicular to the main scan direction and a direction approximately perpendicular thereto). As a result, by moving the relative position between the scale 41 and the sensor 43 in the intersecting direction (including the perpendicular direction and the approximately-perpendicular direction), it is possible to continuously vary the interval of the calibrations 42.

Since the scale 41 is attached to the belt 47 which is driven in the direction intersecting the main scan direction (including a direction perpendicular to the main scan direction and a direction approximately perpendicular thereto) by the motor 48, the relative position to the sensor 43 and can be varied by driving the scale 41 in the intersecting direction (including the perpendicular direction and the approximately-perpendicular direction), thereby varying the interval of the calibrations 42 used for measurement.

Further, by attaching the sensor 43 to the recording head 11*a* and driving the scale 41 in the direction intersecting the main scan direction (including a direction perpendicular to the main scan direction and a direction approximately perpendicular thereto), the recording head 11*a* can be moved only in the main scan direction and thus the structure thereof can be simplified, so that it is not necessary to largely change the conventional structure.

Since the interval of the calibrations 42 selected at the cycle selecting process S10 is selected on the basis of the arrangement cycle of the lenticular sheet 60 and a predetermined number of parallaxes, a parallax image 60*c* different by the number of parallax images can be printed, for example, at a position where one lenticular lens 60*a* is disposed, and the number of dots required for forming each parallax image 60*c* can be made constant. That is, the resolutions can be made equal to one another.

The technical scope of the present invention is not limited to the above embodiment, but various modifications may be made thereto without departing from the gist of the present invention.

For example, although it has been described in the above embodiment that the present invention is applied to the printer for a lenticular sheet on which parallax images of a three-dimensional image can be printed to observe the three-dimensional image, the present invention may be applied to a printer for a lenticular sheet on which parallax images of plural different images can be printed to observe different images depending upon an observation direction, for example, a lenticular sheet which allows a screen to be sequentially varied like a moving picture by varying the observation direction.

Although it has been described in the above embodiment that a lenticular sheet having lenticular lenses is used as a recording medium, an integral sheet having faveolate lenses may be used as a recording medium and various other lens sheets may be also used as a recording medium, in addition to the lenticular sheet.

What is claimed is:

1. A printer comprising:

a recording head that discharges ink to a predetermined position of a recording medium while being moved in a main scan direction relative to the recording medium on which an image is printed;

a recording-head moving unit that moves the recording head in the main scan direction;

a recording-medium moving unit that moves the recording medium in a auxiliary scan direction relative to the recording head; and an encoder that measures at least one of the movement of the recording head and the movement of the recording medium, wherein the encoder includes a scale having calibrations of which an interval is varied in one of a direction different from the movement direction of the recording head and the movement direction of the recording medium and a measuring portion that detects the calibrations, and wherein the interval of the calibrations to be detected by the measuring portion is varied by relatively moving the scale and the measuring portion in one of a direction different from the movement direction of the recording head and the movement direction of the recording medium.

2. The printer according to claim 1, wherein the scale is formed in a rectangular shape and the calibrations are formed to intersect the lengthwise axis direction of the scale, and wherein the scale is disposed such that the lengthwise axis direction is parallel to the movement direction of the recording head or the movement direction of the recording medium.

3. The printer according to claim 1, wherein the interval of the calibrations is varied in one of a direction intersecting the movement direction of the recording head and the movement direction of the recording medium.

4. The printer according to claim 1, wherein the calibrations are formed out of a plurality of straight lines extending radially from a predetermined point outside the scale.

5. The printer according to claim 1, wherein the measuring portion is attached to the recording head, wherein the scale is attached to a belt that is wound around a pair of rollers rotatably disposed and extends in a direction approximately perpendicular to the movement direction of the recording head, and wherein one roller is provided with a motor that drives the scale in the direction intersecting the movement direction of the recording head via the roller and the belt.

6. The printer according to claim 1, wherein the scale is moved in the lengthwise axis direction by the recording-medium moving unit in synchronism with the movement of the recording medium, wherein the measuring portion is attached to a belt that is wound around a pair of rollers rotatably disposed and extends in a direction intersecting the lengthwise axis direction, and wherein one roller is provided with a motor that drives the measuring portion in the direction intersecting the lengthwise axis direction via the roller and the belt.

7. The printer according to claim 1, wherein variation of the calibration interval of the scale is performed by:

selecting a calibration interval after variation from a plurality of the calibration intervals of the scale and changing relative positions of the scale and the measuring portion such that the calibration interval measured by the encoder becomes the calibration interval after variation; and changing a driving cycle of the recording head and an imaging speed of an image on the basis of the calibration interval after variation.

8. The printer according to claim 7, wherein the recording medium is one of a lens sheet having a plurality of lenses arranged on one surface thereof and a print medium having convexities and concavities corresponding to the lenses, and wherein the calibration interval after variation is selected on the basis of the number of parallax images and one of an arrangement cycle of the lenses and the convexities and concavities corresponding to the lenses.

9. The printer according to claim 7, wherein the variation of the calibration interval to be measured by the encoder is performed by moving the scale in the main scan direction through control of driving the motor and thus changing the relative position between the scale and the measuring portion.

10. A printer comprising:

a recording head that discharges ink to a predetermined position of a recording medium while being moved in a main scan direction relative to the recording medium on which an image is printed;

recording-head moving means that moves the recording head in the main scan direction;

recording-medium moving means that moves the recording medium in a auxiliary scan direction relative to the recording head; and an encoder that measures at least one of the movement of the recording head and the movement of the recording medium, wherein the encoder includes a scale having calibrations of which an interval is varied in one of a direction different from the movement direction of the recording head and the movement direction of the recording medium and a measuring portion that detects the calibrations, and wherein the interval of the calibrations to be detected by the measuring portion is varied by relatively moving the scale and the measuring portion in one of a direction different from the movement direction of the recording head and the movement direction of the recording medium.

* * * * *